US011077925B2

(12) United States Patent
Tillotson

(10) Patent No.: US 11,077,925 B2
(45) **Date of Patent: *Aug. 3, 2021**

(54) SYSTEM AND METHOD FOR TRANSPORTING METHANE

(71) Applicant: The Boeing Company, Chicago, IL (US)

(72) Inventor: Brian J. Tillotson, Kent, WA (US)

(73) Assignee: The Boeing Company, Chicago, IL (US)

( * ) Notice: Subject to any disclaimer, the term of this patent is extended or adjusted under 35 U.S.C. 154(b) by 82 days.

This patent is subject to a terminal disclaimer.

(21) Appl. No.: 16/542,911

(22) Filed: Aug. 16, 2019

(65) Prior Publication Data

US 2020/0001957 A1 Jan. 2, 2020

Related U.S. Application Data

(63) Continuation of application No. 15/289,622, filed on Oct. 10, 2016, now Pat. No. 10,435,125.

(51) Int. Cl.
*F17C 7/02* (2006.01)
*B63G 8/00* (2006.01)
(Continued)

(52) U.S. Cl.
CPC ..... *B63G 8/001* (2013.01); *B63G 8/12* (2013.01); *F17C 1/007* (2013.01); *F17C 5/00* (2013.01); *F17C 7/00* (2013.01); *F17C 7/02* (2013.01); *B63G 2008/002* (2013.01); *F17C 2201/0109* (2013.01); *F17C 2201/035* (2013.01); *F17C 2201/054* (2013.01);
(Continued)

(58) Field of Classification Search
CPC ..... F17C 2270/0131
See application file for complete search history.

(56) References Cited

U.S. PATENT DOCUMENTS 3,975,167 A * 8/1976 Nierman ..... F17C 11/007 585/15
9,435,179 B1 * 9/2016 McIntyre ..... E02B 15/0857
9,481,430 B2 11/2016 Cheatham, III et al.

OTHER PUBLICATIONS

Egorov, A.V., et al., "Transformation of deep-water methane bubbles into hydrate," *Geofluids,* 2014, vol. 14, pp. 430-442.

(Continued)

*Primary Examiner* — Andrew Polay
(74) *Attorney, Agent, or Firm* — Womble Bond Dickinson (US) LLP

(57) ABSTRACT

A methane transportation system is provided. The system may include a methane source configured to dispense methane at a first location, and an underwater vehicle. The underwater vehicle may include a propulsion system configured to transport the underwater vehicle underwater from the first location to a second location and a vessel defining a storage chamber configured to receive water and the methane from the methane source. The storage chamber of the vessel may have a pressure exceeding one atmosphere and a temperature during transport from the first location to the second location sufficient to form methane clathrate in the storage chamber. The system may further include a methane receiver configured to receive the methane released from the storage chamber at the second location. Related methods are also provided.

12 Claims, 8 Drawing Sheets

(51) Int. Cl.

| | |
|---|---|
| ***B63G 8/12*** | (2006.01) |
| ***F17C 1/00*** | (2006.01) |
| ***F17C 5/00*** | (2006.01) |
| ***F17C 7/00*** | (2006.01) |

(52) U.S. Cl.

CPC ..... *F17C 2203/0617* (2013.01); *F17C 2205/0323* (2013.01); *F17C 2205/0397* (2013.01); *F17C 2221/033* (2013.01); *F17C 2223/0123* (2013.01); *F17C 2223/0138* (2013.01); *F17C 2223/0176* (2013.01); *F17C 2223/033* (2013.01); *F17C 2223/036* (2013.01); *F17C 2223/043* (2013.01); *F17C 2225/0123* (2013.01); *F17C 2225/0138* (2013.01); *F17C 2225/0176* (2013.01); *F17C 2225/036* (2013.01); *F17C 2225/042* (2013.01); *F17C 2227/0157* (2013.01); *F17C 2227/0318* (2013.01); *F17C 2227/0351* (2013.01); *F17C 2265/06* (2013.01); *F17C 2270/0131* (2013.01)

(56) References Cited

OTHER PUBLICATIONS

Wolman, David, "Gas Goes Solid," MIT Technology Review, Apr. 11, 2003 (Year: 2003).

* cited by examiner

SYSTEM AND METHOD FOR TRANSPORTING METHANE

CROSS-REFERENCE TO RELATED APPLICATIONS

This application is a continuation of U.S. application Ser. No. 15/289,622, filed Oct. 10, 2016, which application is hereby incorporated by reference in its entirety in this application.

BACKGROUND

Field of the Disclosure

The present disclosure relates to transport of methane. More particularly, the present disclosure relates to transport of methane by sea.

Description of Related Art

Many governments, as well as some companies, seek to reduce greenhouse warming of the Earth, but cannot escape their dependence on fossil fuels. Methane is a preferable fossil fuel, emitting less carbon per joule than other fossil fuels. Moving methane by pipeline works well on land. However, pipelines do not work for transporting methane long distances across oceans.

Traditionally, methane is rarely transported by ship on the seas because the cost to make methane dense enough for economical shipping is prohibitive. In this regard, methane may be subjected to cryogenic refrigeration, high pressures, or both in order to provide the necessary density. The methane (or natural gas, which is mostly methane) must be liquefied, which may require temperatures below minus twenty Celsius. However, obtaining such temperatures and pressures typically requires substantial quantities of energy, thereby increasing the cost thereof, and making such transport economically infeasible. Further, ships able to refrigerate large volumes well enough to keep methane liquefied are relatively expensive. Therefore, methane is used very little in regions without indigenous sources.

However, it may be desirable to transport methane by sea. Thus, advances with respect to methane transport may be desirable.

BRIEF SUMMARY OF THE DISCLOSURE

The present disclosure relates to methane transport by sea. According to one aspect, an unmanned underwater vehicle (UUV) transports methane. The UUV exploits the ambient high pressure and cool temperature of the deep oceanic environment to convert methane into methane clathrate, a solid which is safe and easy to ship. This process may allow more widespread use of natural gas, displacing coal and petroleum and improving energy security of some regions.

According to one aspect, a methane transportation system is provided. The methane transportation system may include a methane source configured to dispense methane at a first location. Further, the methane transportation system may include an underwater vehicle including a propulsion system configured to transport the underwater vehicle under water from the first location to a second location and a vessel defining a storage chamber configured to receive water and the methane from the methane source, the storage chamber of the vessel having a pressure exceeding one atmosphere and a temperature during transport from the first location to the second location sufficient to form methane clathrate in the storage chamber. The methane transportation may additionally include a methane receiver configured to receive the methane released from the storage chamber at the second location.

In some implementations the vessel may include an inlet port configured to receive the methane from the methane source and an outlet port configured to dispense the methane to the methane receiver. The methane source may include a supply conduit configured to seal with the inlet port to positively pressurize the vessel with the methane to produce the methane clathrate. The inlet port may be decoupled from the methane source while the underwater vehicle is at the first location and receiving the methane, and the storage chamber may be exposed via the inlet port to an ambient pressure and an ambient temperature sufficient to produce the methane clathrate. The methane source defines an outlet, the outlet being positioned under the inlet port while the underwater vehicle is at the first location.

In some implementations the methane receiver may be configured to seal with the outlet to receive the methane from the vessel while the underwater vehicle is at the second location. The methane receiver may be decoupled from the outlet port while the underwater vehicle is at the second location and dispensing the methane. The methane receiver may include a collector, the collector being positioned above the outlet port and configured to receive the methane exiting the vessel through the outlet port while the underwater vehicle is at the second location.

In an additional aspect, a methane transportation method is provided. The method may include positioning an underwater vehicle including a vessel defining a storage chamber at a first location. Further, the method may include at least partially filling the storage chamber with water. The method may additionally include dispensing methane into the storage chamber at the first location. Additionally, the method may include providing the storage chamber of the vessel with a pressure exceeding one atmosphere and a temperature that forms the methane and the water into methane clathrate. The method may further include transporting the underwater vehicle from the first location to a second location. Further, the method may include dispensing the methane from the vessel at the second location.

In some implementations providing the vessel with the pressure exceeding one atmosphere and the temperature that forms the methane and the water into methane clathrate may include positively pressurizing the vessel with the methane to produce the methane clathrate. Dispensing the methane into the storage chamber at the first location may include sealing an outlet of a supply conduit with an inlet port of the vessel. Providing the vessel with the pressure exceeding one atmosphere and the temperature that forms the methane and the water into methane clathrate may include exposing the storage chamber to an ambient pressure and an ambient temperature sufficient to produce the methane clathrate. Dispensing the methane into the storage chamber at the first location may include dispensing the methane underneath an inlet port of the vessel.

In some implementations transporting the underwater vehicle from the first location to the second location and providing the vessel with the pressure exceeding one atmosphere and the temperature that forms the methane and the water into methane clathrate may include transporting the underwater vehicle at a depth sufficient to form the methane clathrate. Transporting the underwater vehicle from the first location to the second location may further include decreasing the depth of the vessel to reach the second location and melt the methane clathrate. Dispensing the methane from the vessel at the second location may include sealing an outlet port of the vessel with a methane receiver.

In some implementations dispensing the methane from the vessel at the second location may include dispensing the methane from an outlet port of the vessel into a collector positioned above the outlet port. Dispensing the methane may include dispensing the methane clathrate. Dispensing the methane may include melting the methane clathrate and dispensing the methane as a gas. Dispensing methane into the storage chamber at the first location may include cooling the methane in a submerged supply conduit through which the methane is dispensed.

These and other features, aspects, and advantages of the disclosure will be apparent from a reading of the following detailed description together with the accompanying drawings, which are briefly described below.

BRIEF DESCRIPTION OF THE FIGURES

Figure 1:
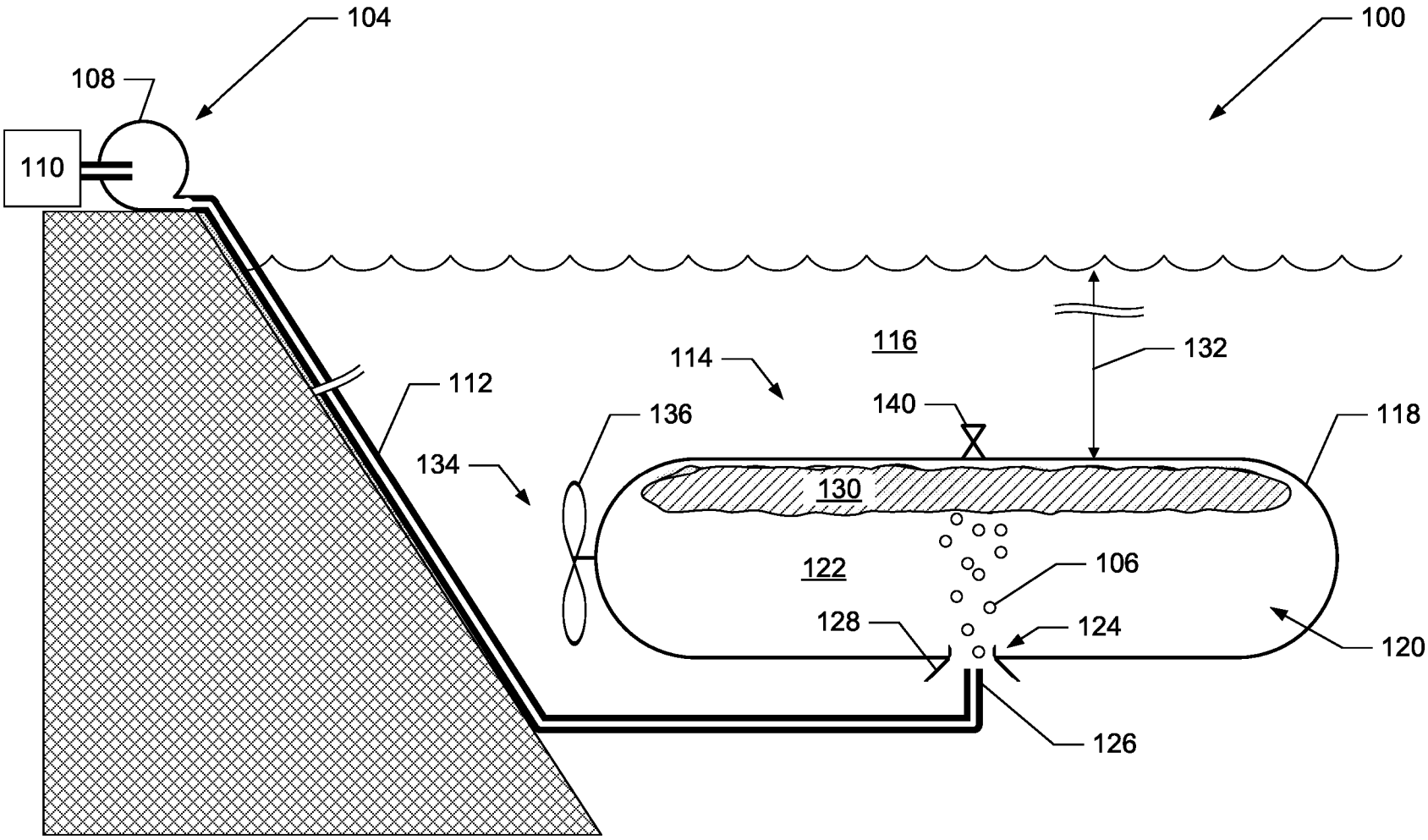
Figure 2:
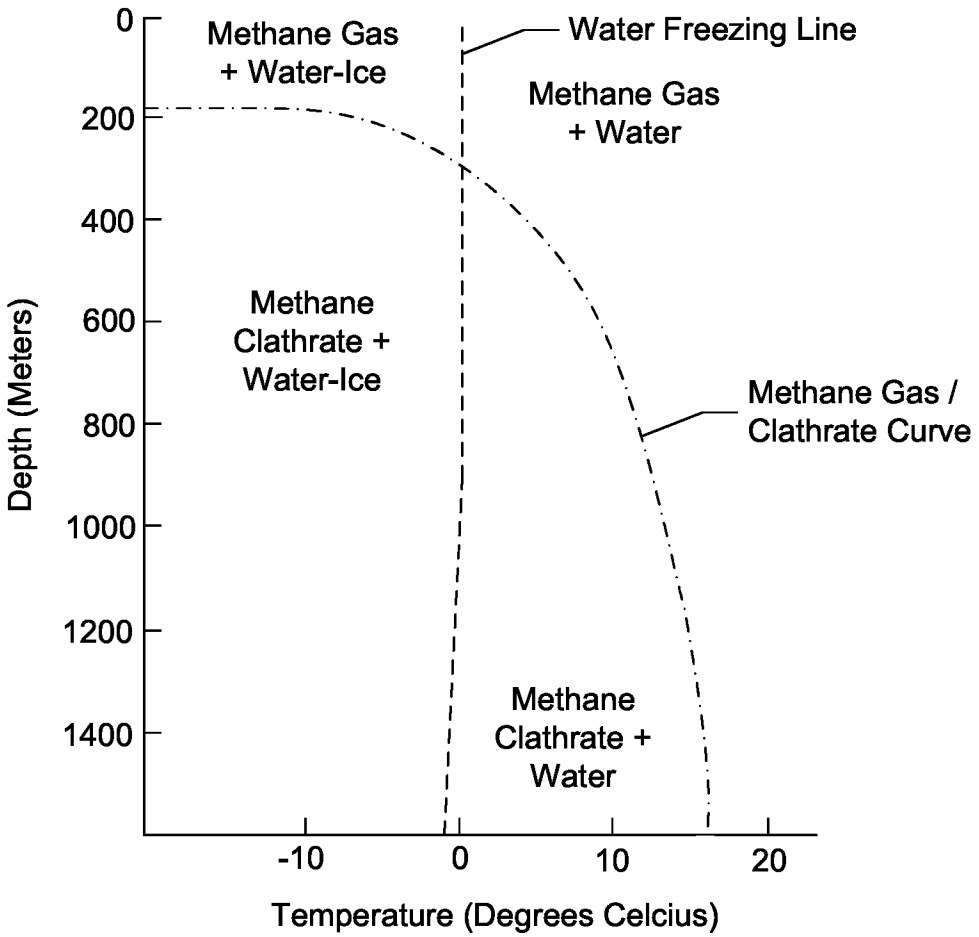
Figure 3:
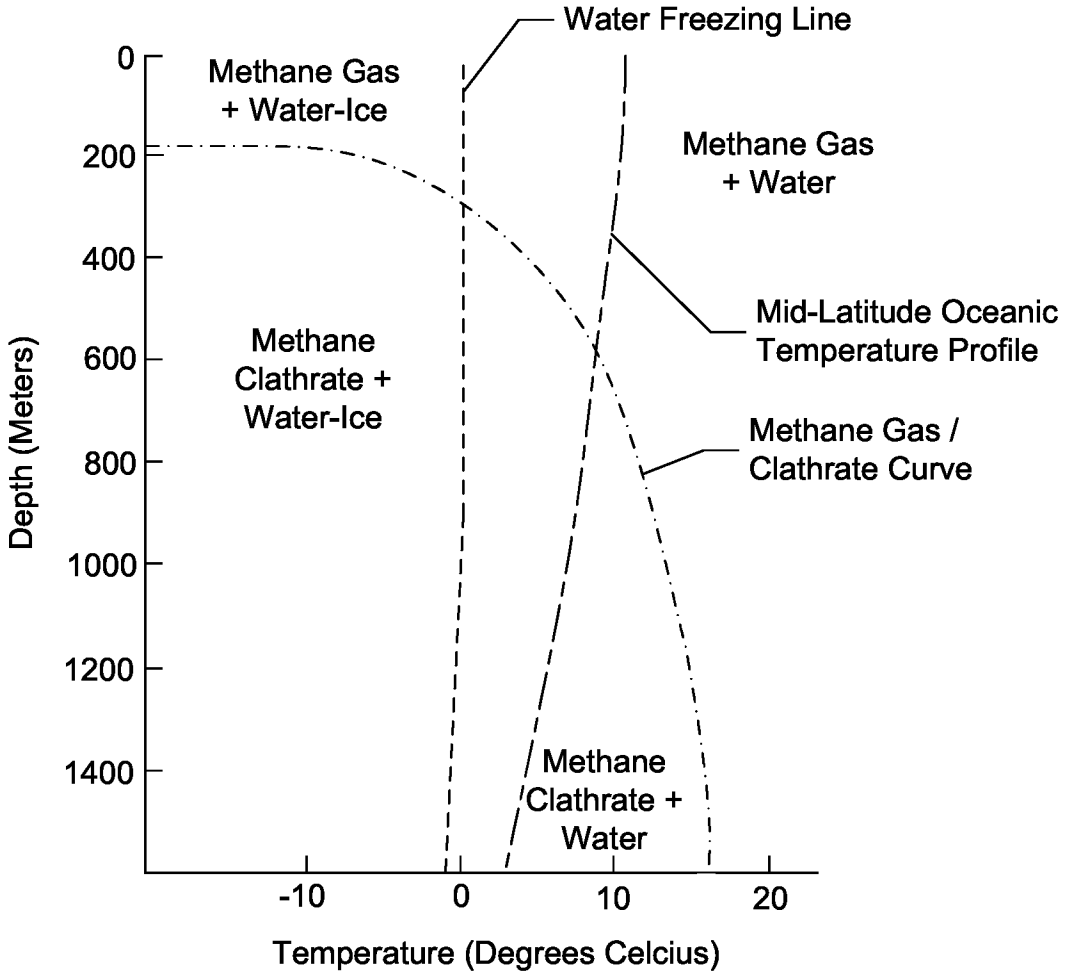
Figure 4:
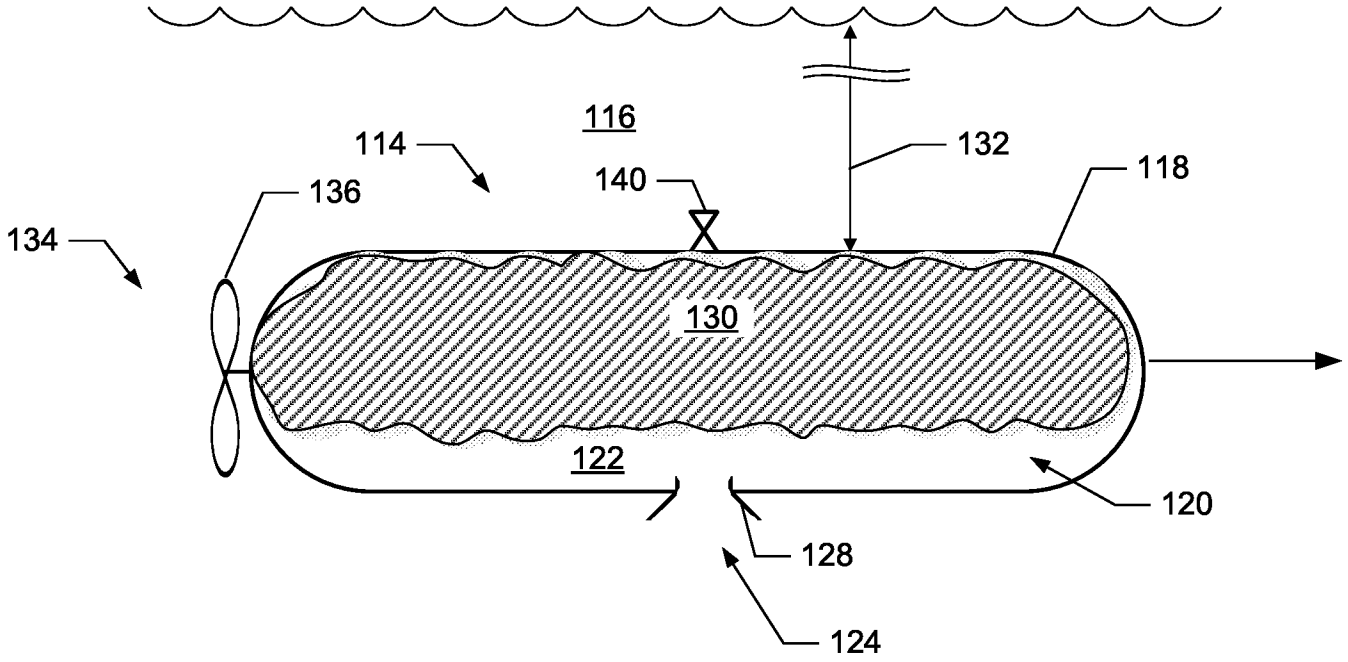
Figure 5:
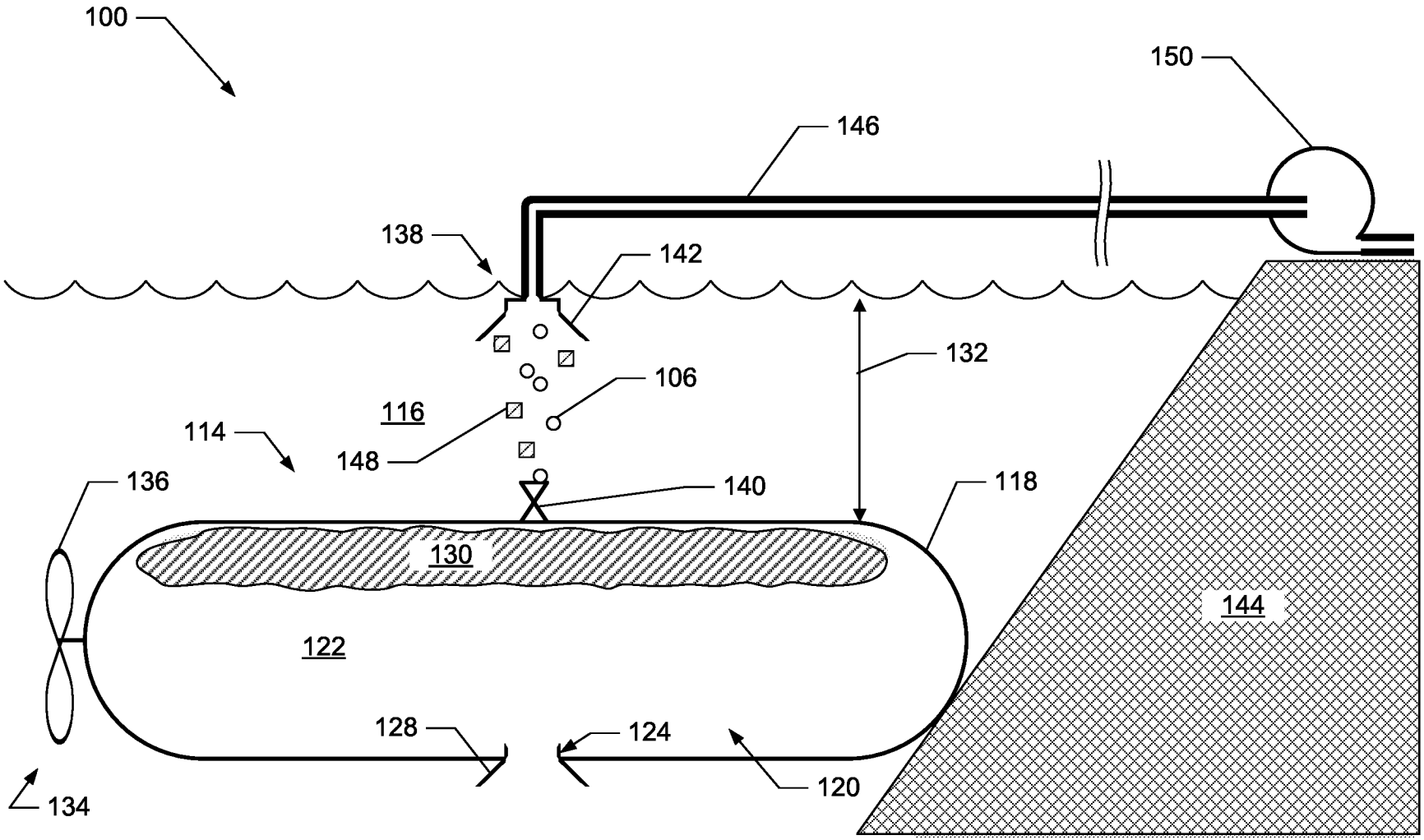
Figure 6:
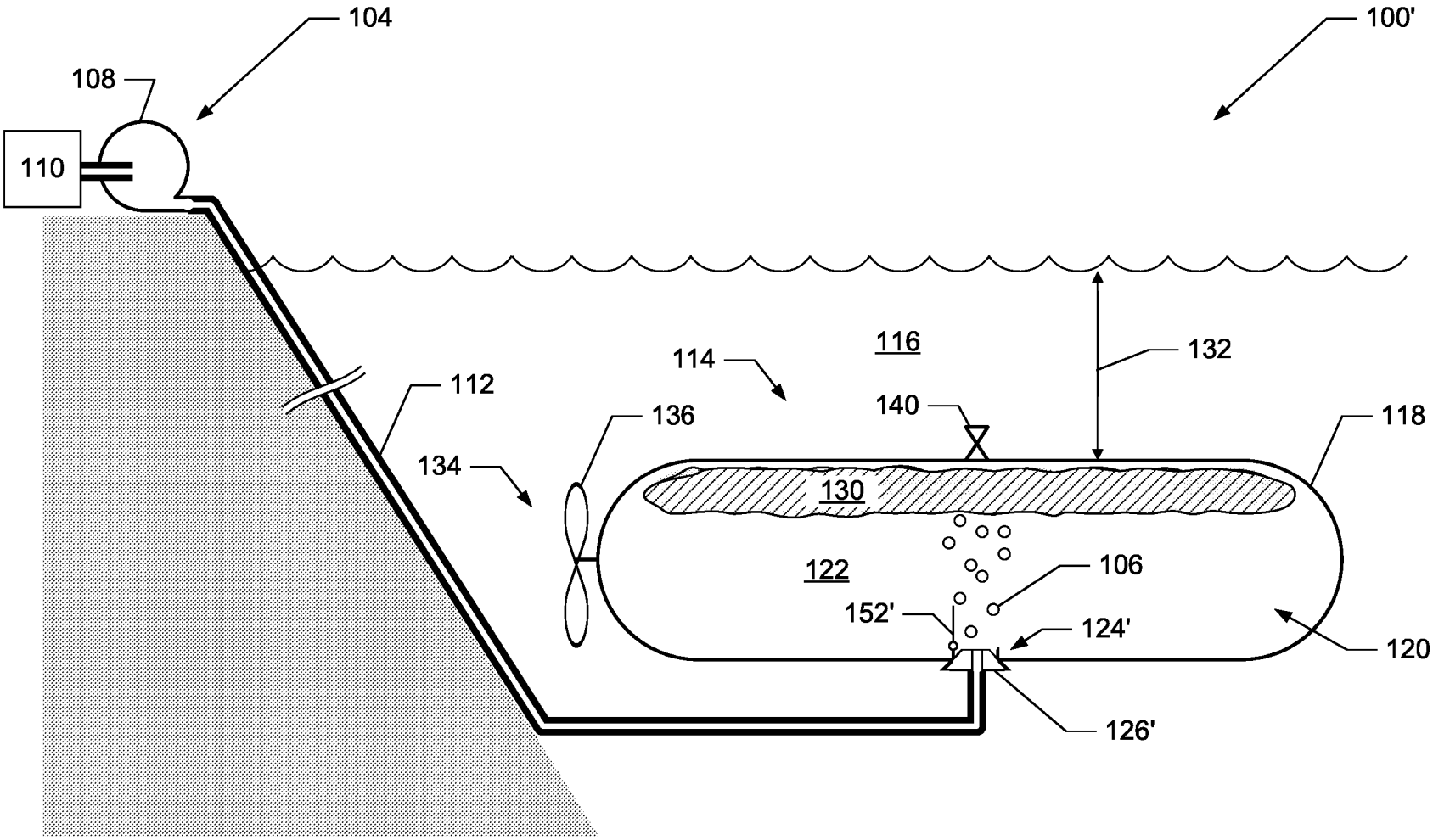
Figure 7:
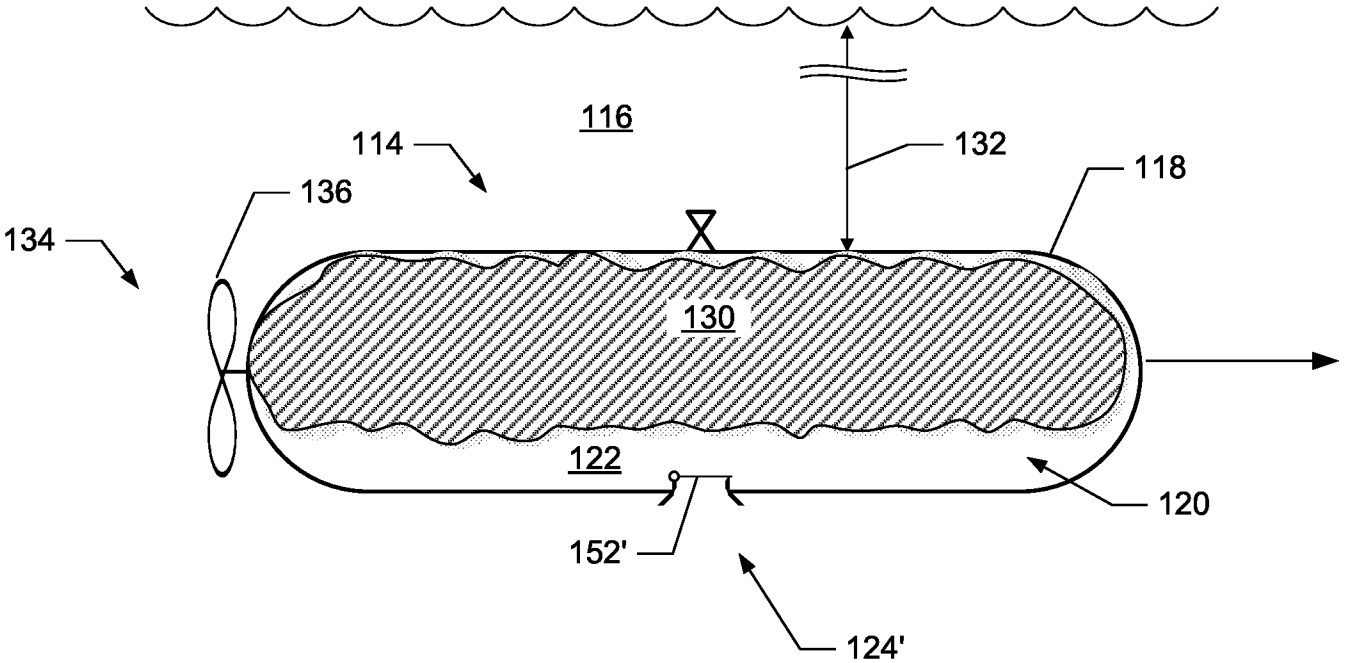
Figure 8:
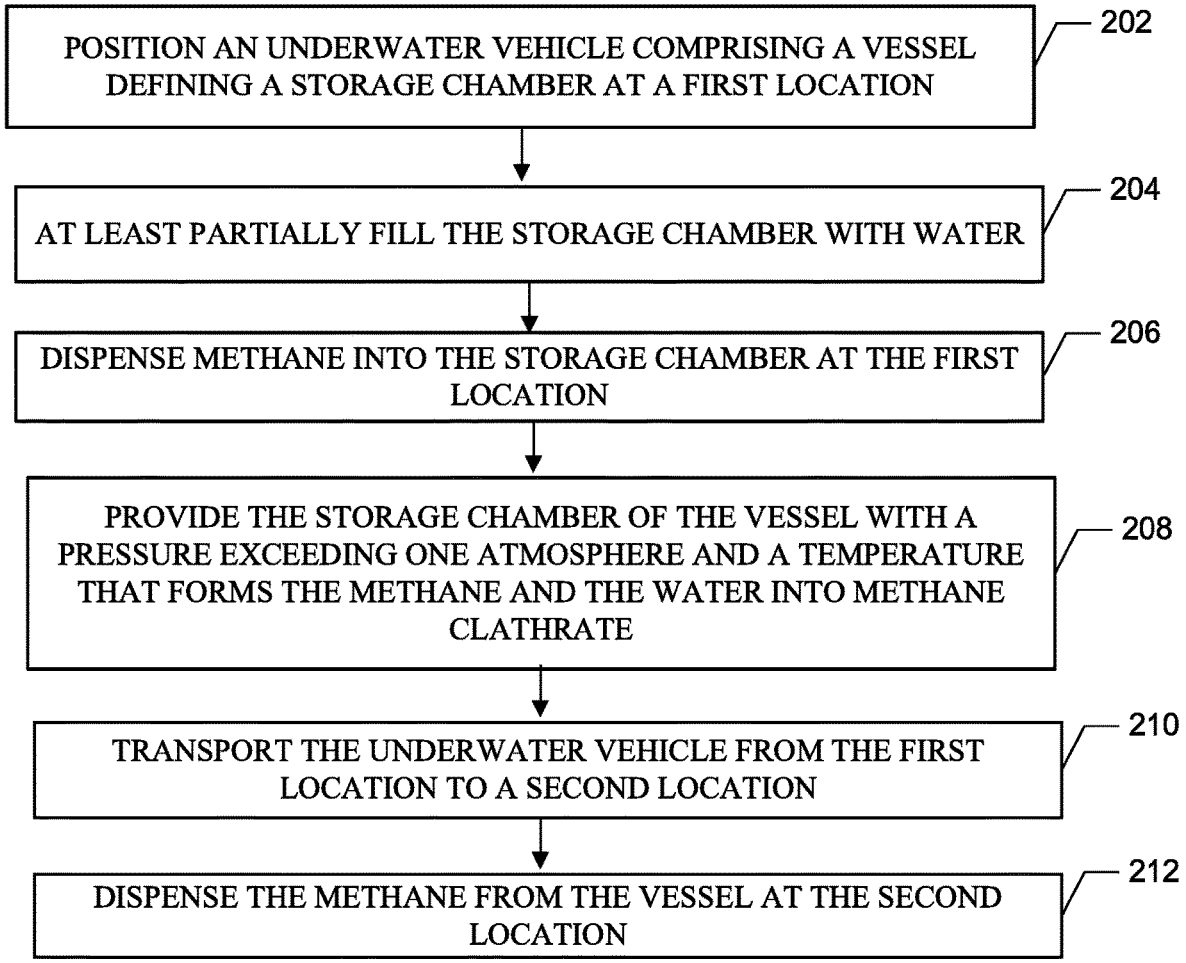

Having thus described the disclosure in the foregoing general terms, reference will now be made to the accompanying drawings, which are not necessarily drawn to scale, and wherein:

FIG. 1 illustrates a methane transportation system wherein an underwater vehicle thereof is at a first location at which the underwater vehicle receives methane according to an example implementation of the present disclosure;

FIG. 2 illustrates a methane depth-temperature phase diagram;

FIG. 3 illustrates a methane depth-temperature phase diagram further including a graph of typical ocean temperature versus depth;

FIG. 4 illustrates the underwater vehicle of FIG. 1 during transportation according to an example implementation of the present disclosure;

FIG. 5 illustrates the methane transportation system of FIG. 1 dispensing methane from the underwater vehicle at a second location, differing from the first location, according to an example implementation of the present disclosure;

FIG. 6 illustrates a methane transportation system wherein an underwater vehicle thereof is pressurized with methane at a first location according to an example implementation of the present disclosure;

FIG. 7 illustrates the underwater vehicle of FIG. 6 during transportation according to an example implementation of the present disclosure; and FIG. 8 schematically illustrates a methane transportation method according to an example implementation of the present disclosure.

DETAILED DESCRIPTION OF PREFERRED IMPLEMENTATIONS

The present disclosure will now be described more fully hereinafter with reference to exemplary implementations thereof. These exemplary implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification, and in the appended claims, the singular forms "a", "an", "the", include plural variations unless the context clearly dictates otherwise.

As described hereinafter, the present disclosure relates to the transport of the methane. More particularly, the present disclosure relates to a system and method for transporting methane by sea. The system and method provided herein may avoid challenges with respect to transport of methane via surface vessels (e.g., tanker ships).

In this regard, FIG. 1 illustrates a methane transportation system 100 according to the present disclosure. As illustrated, the methane transportation system 100 may include a methane source 104. The methane source 104 may be configured to dispense methane 106 at a first location.

In this regard, the methane source 104 may include a supply pump 108. The supply pump 108 may be coupled to a source vessel or conduit 110. Thereby, the supply pump 108 may pressurize the methane 106 received from the source vessel or conduit 110 and direct the methane through a supply conduit 112 (e.g., a hose or pipe) to an underwater vehicle 114. The methane 106 may be heated during compression by the supply pump 108. However, seawater 116 surrounding the supply conduit 112 may cool the methane 106 during transport therethrough to the underwater vehicle 114.

The underwater vehicle 114 may include a vessel 118 defining a storage chamber 120. The storage chamber 120 may be configured to receive water 122, which may be received from the surrounding seawater 116. Further, the storage chamber 120 may be configured to receive the methane 106 from the methane source 104.

In this regard, the vessel 118 may comprise an inlet port 124 configured to receive the methane 106 from the methane source 104. In one implementation the inlet port 124 may be decoupled from the methane source 104 while the underwater vehicle is at the first location and receiving the methane 106. In this regard, as illustrated in FIG. 1, an outlet 126 of the supply conduit 112 may be positioned under the inlet port 124 of the vessel 118 while the underwater vehicle 114 is at the first location. The methane 106 may be provided by the methane source 104 as a gas, such that the methane bubbles up through the water 122 in the vessel 118, and optionally first through the surrounding seawater 116, into the storage chamber 120. For example, the inlet port 124 may include a funnel 128 that receives the upwardly moving bubbles of methane 106 and directs the methane into the storage chamber 120.

Note that although the outlet 126 of the supply conduit 112 is described above and illustrated in FIG. 1 as being decoupled from the inlet port 124, in other implementations the outlet may be in contact with the inlet port, and optionally extend therethrough, into the storage chamber 120. In this implementation, the outlet 126 of the supply conduit 112 may not seal with respect to the inlet port 124 such that the methane 106 does not increase the pressure in the storage chamber 120. However, as described below, in an alternative implementation the outlet of the supply conduit may seal with respect to the inlet port in order to pressurize the storage chamber.

The storage chamber 120 of the vessel 118 may have a pressure and a temperature sufficient to form methane clathrate 130, also known as methane hydrate, in the storage chamber 120. At sufficiently high pressure (e.g., corresponding to a depth of at least about 200 meters) and sufficiently cool temperature (e.g., corresponding to a temperature of less than about seventeen degrees Celsius), each molecule of the methane 106 binds with several molecules of the water 122 to form the methane clathrate 130, which is a solid. In this regard, the conditions necessary for the formation of methane clathrate are illustrated in FIG. 2, which is a methane clathrate pressure-temperature phase diagram. The area to the right of and above the dashed and dotted line reflects conditions in which methane may have a gaseous form. The area to the left of and below the dashed and dotted line reflects conditions at which methane clathrate may form.

Thus, in order for the methane clathrate to form in the storage chamber 120 (see, FIG. 1), a positive pressure may be defined therein. In other words, the pressure may exceed one atmosphere (i.e., one atm, or 101.325 kpa). More particularly, the storage chamber 120 may define pressure and temperature conditions corresponding to those to the right of the water freezing line and below the methane gas/clathrate curve in the methane depth-temperature phase diagram of FIG. 2, which correspond to conditions at which methane clathrate may form in water.

Further, the additional dashed curve in FIG. 3 illustrates a graph of the typical oceanic water temperature associated with specified depths. The particular temperature of the water will vary from this curve depending on the season and location. However, as will be understood, the temperature generally decreases with depth. In the figure, it is apparent that the curve of typical temperatures crosses the methane gas/clathrate curve at about 600 meters depth. Thus, typical temperatures and pressures below a depth of about 600 meters are sufficient to form methane clathrate at mid-latitude oceanic locations.

In this regard, the location at which the underwater vehicle 114 receives the methane may define an ambient pressure and temperature sufficient to convert the methane 106 into methane clathrate 130. Further, the storage chamber 120 may be exposed via the inlet port 124 to the ambient pressure and the ambient temperature of the ocean at the location at which the underwater vehicle 114 is located. Thus, for example, the location at which the underwater vehicle is filled may be at a relatively large depth 132, which may be at least about 600 meters in practice at mid-latitude oceanic locations.

Thereby, the methane 106 bubbled into the storage chamber 120 full of water 122 may form the methane clathrate 130. In particular, as the methane 106 forms methane clathrate 130, the methane clathrate, which defines a density less than the water 122, may float to the top of the storage chamber 120, displacing some of the water out of the inlet port 124. Accordingly, the methane clathrate 130 may at least partially fill the storage chamber 120.

Once the storage chamber 120 is filled to a desired extent with the methane clathrate 130 at the first location, the underwater vehicle 114 may be transported to a second location, at which the methane clathrate is dispensed. In some implementations the underwater vehicle 114 may include a propulsion system 134. For example, the propulsion system 134 may include an electric motor, an internal combustion engine, or any other motive power source. Further, by way of example, the propulsion system 134 may include a propeller 136. Thereby, the propulsion system 134 may transport the underwater vehicle 114 underwater from the first location to the second location, as illustrated in FIG. 4.

In some implementations the underwater vehicle 114 may comprise an unmanned underwater vehicle (UUV), which is controlled without an onboard human operator. However, in other implementations the underwater vehicle 114 may comprise a piloted underwater vehicle (OPUV).

The storage chamber 120 of the vessel 118 may have a pressure and a temperature during transport from the first location to the second location sufficient to retain methane clathrate in the storage chamber. In this regard, the storage chamber 120 may have a positive pressure and a temperature sufficient to form the methane clathrate as described above. The storage chamber 120 may remain exposed to the surrounding temperature and pressure during movement of the underwater vehicle 114 from the first location to the second location. For example, the inlet port 124 may remain open during transportation. Alternatively, the inlet port 124 may be closed during movement of the underwater vehicle 114.

During transport, for most or the entirety of the journey of the underwater vehicle 114, the depth 132 at which the underwater vehicle travels may provide conditions sufficient to form/retain the methane clathrate. Brief intervals of travel at depths 132 that are relatively shallower, and which may not support the formation of methane clathrate, such as traversing the Straits of Malacca, may be possible. In this regard, heat causing vaporization and formation of methane gas must be absorbed from the surrounding seawater 116 to convert the methane clathrate 130 back into methane and water. The rate of heat transfer is fairly low, especially for large volumes of the methane clathrate 130 received in the storage chamber 120, so relatively little methane clathrate may sublime and melt as long as the intervals at shallow depths are relatively brief.

As, illustrated in FIG. 5, upon reaching the second location, the underwater vehicle 114 may dispense or unload the contents of the storage chamber 120. In this regard, the methane transportation system 100 may further comprise a methane receiver 138 configured to receive the methane released from the storage chamber 120 at the second location. Further, the vessel 118 may include an outlet port 140 configured to dispense the methane 106 to the methane receiver 138.

As illustrated in FIG. 5, in some implementations some or all of the methane 106 may be dispensed as a gas. In this regard, the conditions at the second location (i.e. the pressure and temperature) may be sufficient to transform the methane clathrate 130 back into methane 106 in gaseous form and water. For example, the underwater vehicle 114 may ascend to a shallower depth 132 and engage a receiving terminal 144. Over time, the warmer water and lower pressure at the second location may melt the methane clathrate 130. Methane 106 may rise to the top of the storage chamber 120, where it exits through the outlet port 140 and enters a receiving conduit 146 (e.g., a pipe or hose). In this regard, the methane receiver 138 may comprise a collector 142. The collector 142 may be positioned above the outlet port 140 and configured to receive the methane 106 exiting the vessel 118 through the outlet port and bubbling up through the seawater 116 while the underwater vehicle 114 is at the second location.

In this regard, in some implementations the methane receiver 138 may be decoupled from the outlet port 140 while the underwater vehicle 114 is at the second location and dispensing the methane 106. However, in other implementations the methane receiver 138 may be configured to seal with the outlet port 140 to receive the methane from the vessel 118 while the underwater vehicle 114 is at the second location. This configuration may ensure collection of substantially all of the methane 106 transported by the vessel 118, outside of minor losses that may be associated with sealing to the outlet port 140 and transporting the methane therefrom.

As noted above, in some implementations the methane clathrate may melt prior to being dispensed as the methane gas 106. As further illustrated in FIG. 5, in another implementation some or all of the methane may be dispensed as methane clathrate 130. In this regard, the outlet port 140 may comprise a hatch with a relatively large opening sufficient to allow chunks 148 of the methane clathrate 130, which is less dense than the seawater 116, to float up therethrough to the methane receiver 138. In this implementation the collector 142 may comprise a catchment area, for example, surrounded by bumpers, docks, or other barriers, at which the methane clathrate may be gathered. Alternatively, the collector 142 may be enclosed, as illustrated, such that the chunks 148 of the methane clathrate 130 received therein may melt and the methane 106 in gaseous form may be transported therefrom by the receiving conduit 146. The receiving conduit 146 may be connected to a receiving pump 150, which may transport the methane 106 to tanks or pipelines for further transport or use.

In the implementation described above, the storage chamber 120 may be filled at an ambient pressure and temperature sufficient to form the methane clathrate 130. In this regard, the underwater vehicle 114 may be filled at a first location having a relatively large depth 132.

However, FIG. 6 illustrates an alternate implementation of the methane transportation system 100' wherein the outlet 126' of the supply conduit 112 is configured to seal with the inlet port 124' to positively pressurize the storage chamber 120 of the vessel 118 with the methane 106 to produce the methane clathrate 130. Pressurized filling of the storage chamber 120 of the vessel 118 may allow for the formation of the methane clathrate 130 at a relatively shallower depth 132. Thereby, filling of the underwater vehicle 114 may occur at seaports having relatively shallower depths, thereby expanding the usability of the methane transportation system 100'. In this implementation the vessel 118 may be configured to withstand an increased pressure relative to the ambient seawater 116.

Further, in this implementation, the inlet port 124' may be configured to seal shut to maintain the pressure applied by the supply conduit 112. In this regard, the inlet port 124' may comprise a valve 152' configured to seal shut after the storage chamber 120 is pressurized. Thereby, as illustrated in FIG. 7, the valve 152' may maintain the inlet port 124' in a closed position during movement of the underwater vehicle 114 to the second location in the manner described above.

In an additional aspect a methane transportation method is provided. As illustrated in FIG. 8, the method may include positioning an underwater vehicle comprising a vessel defining a storage chamber at a first location at operation 202. Further, the method may include at least partially filling the storage chamber with water at operation 204. The method may additionally include dispensing methane into the storage chamber at the first location at operation 206. The method may further include providing the storage chamber of the vessel with a pressure exceeding one atmosphere and a temperature that forms the methane and the water into methane clathrate at operation 208. The method may also include transporting the underwater vehicle from the first location to a second location at operation 210. Additionally, the method may include dispensing the methane from the vessel at the second location at operation 212.

In some implementations providing the vessel with the pressure exceeding one atmosphere and the temperature that forms the methane and the water into methane clathrate at operation 208 may comprise positively pressurizing the vessel with the methane to produce the methane clathrate. Dispensing the methane into the storage chamber at the first location at operation 206 may comprise sealing an outlet of a supply conduit with an inlet port of the vessel. Providing the vessel with the pressure exceeding one atmosphere and the temperature that forms the methane and the water into methane clathrate at operation 208 may comprise exposing the storage chamber to an ambient pressure and an ambient temperature sufficient to produce the methane clathrate.

In some implementations dispensing the methane into the storage chamber at the first location at operation 206 may comprise dispensing the methane underneath an inlet port of the vessel. Transporting the underwater vehicle from the first location to the second location at operation 210 and providing the vessel with the pressure exceeding one atmosphere and the temperature that forms the methane and the water into methane clathrate at operation 208 may comprise transporting the underwater vehicle at a depth sufficient to form the methane clathrate. Transporting the underwater vehicle from the first location to the second location at operation 210 may further comprise decreasing the depth of the vessel to reach the second location and melt the methane clathrate.

In some implementations dispensing the methane from the vessel at the second location at operation 212 may comprise sealing an outlet port of the vessel with a methane receiver. Dispensing the methane from the vessel at the second location at operation 212 may comprise dispensing the methane from an outlet port of the vessel into a collector positioned above the outlet port. Dispensing the methane at operation 212 may comprise dispensing the methane clathrate. Dispensing the methane at operation 212 may comprise melting the methane clathrate and dispensing the methane as a gas. As may be understood, methane clathrate may be converted back into methane gas and water by increasing the temperature and/or decreasing the pressure applied thereto. In this regard, the conditions at which methane gas is formed are illustrated in FIGS. 2 and 3 and are defined above and to the right of the dashed and dotted line. Dispensing methane into the storage chamber at the first location at operation 206 may comprise cooling the methane in a submerged supply conduit through which the methane is dispensed.

Implementations of the present disclosure may provide one or more benefits as compared to other implementations of mechanisms and methods for methane transport. In this regard, as compared to moving methane by pipeline, the methods and systems of the present disclosure allow long-distance transport across oceans. It also mitigates risks of fires due to the underwater vehicle being surrounded by water and due to the methane being provided in methane clathrate form, rather than gaseous form. Further, compared to transporting methane on ships, the methods and systems of the present disclosure exploit the natural undersea environment to keep the methane in a convenient, dense form. This avoids the large cost of refrigeration, insulation, and the inefficient configuration of liquid natural gas (LNG) tankers. Traveling underwater avoids most weather problems and the associated costs. Traveling underwater also avoids piracy.

Many modifications and other implementations of the disclosure will come to mind to one skilled in the art to which this disclosure pertains having the benefit of the teachings presented in the foregoing descriptions and the associated drawings. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

The invention claimed is:

1. A methane transportation method, comprising:

positioning an underwater vehicle comprising a vessel defining a storage chamber at a first location;

at least partially filling the storage chamber with water;

a first dispensing of methane into the storage chamber at the first location;

providing the storage chamber of the vessel with a pressure exceeding one atmosphere and a temperature that forms the methane and the water into methane clathrate;

transporting the underwater vehicle from the first location to a second location; and a second dispensing of the methane from the vessel at the second location, the methane dispensed from an outlet port of the vessel into a collector positioned directly above and decoupled from the outlet port while the methane is dispensed.

2. The methane transportation method of claim 1, wherein providing the vessel with the pressure exceeding one atmosphere and the temperature that forms the methane and the water into methane clathrate comprises positively pressurizing the vessel with the methane to produce the methane clathrate.

3. The methane transportation method of claim 2, wherein the first dispensing of the methane into the storage chamber at the first location comprises sealing an outlet of a supply conduit with an inlet port of the vessel.

4. The methane transportation method of claim 1, wherein providing the vessel with the pressure exceeding one atmosphere and the temperature that forms the methane and the water into methane clathrate comprises exposing the storage chamber to an ambient pressure and an ambient temperature sufficient to produce the methane clathrate.

5. The methane transportation method of claim 4, wherein the first dispensing of the methane into the storage chamber at the first location comprises dispensing the methane underneath an inlet port of the vessel.

6. The methane transportation method of claim 1, wherein transporting the underwater vehicle from the first location to the second location and providing the vessel with the pressure exceeding one atmosphere and the temperature that forms the methane and the water into methane clathrate comprises transporting the underwater vehicle at a depth sufficient to form the methane clathrate.

7. The methane transportation method of claim 6, wherein transporting the underwater vehicle from the first location to the second location further comprises decreasing the depth of the vessel to reach the second location and melt the methane clathrate.

8. The methane transportation method of claim 1, wherein the second dispensing of the methane from the vessel at the second location comprises dispensing the methane clathrate.

9. The methane transportation method of claim 1, wherein the second dispensing of the methane from the vessel at the second location comprises melting the methane clathrate and dispensing the methane as a gas.

10. The methane transportation method of claim 1, wherein the first dispensing of the methane into the storage chamber at the first location comprises cooling the methane in a submerged supply conduit through which the methane is dispensed.

11. The methane transportation method of claim 1, wherein the first dispensing of the methane into the storage chamber at the first location comprises dispensing the methane from a methane source into an inlet port of the vessel, the inlet port decoupled from the methane source while the methane is dispensed from the methane source.

12. The methane transportation method of claim 1, wherein the second dispensing of the methane from the vessel at the second location comprises dispensing at least some of the methane clathrate, and melting at least some of the methane clathrate that is dispensed as a gas.

* * * * *